US006712004B2

(12) United States Patent
Sugiyama et al.

(10) Patent No.: US 6,712,004 B2
(45) Date of Patent: Mar. 30, 2004

(54) PLATE INSERTING APPARATUS

(75) Inventors: Hiroyuki Sugiyama, Ibaraki (JP); Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/412,972

(22) Filed: Apr. 11, 2003

(65) Prior Publication Data

US 2003/0192444 A1 Oct. 16, 2003

(30) Foreign Application Priority Data

Apr. 12, 2002 (JP) ..... 2002-110892

(51) Int. Cl.[7] ..... B41L 47/14; B41F 27/12
(52) U.S. Cl. ..... 101/477; 101/415.1
(58) Field of Search ..... 101/477, 415.1, 101/480, 378

(56) References Cited

U.S. PATENT DOCUMENTS 5,440,988 A * 8/1995 Ito ..... 101/477
5,555,810 A * 9/1996 Stiel ..... 101/477
5,758,578 A * 6/1998 Metrope ..... 101/477
6,216,594 B1 * 4/2001 Nakano et al. ..... 101/477
6,463,853 B1 * 10/2002 Asai ..... 101/477
6,467,411 B1 * 10/2002 Naniwa et al. ..... 101/477
6,481,351 B1 * 11/2002 Edinger et al. ..... 101/477
6,499,400 B2 * 12/2002 Onuma et al. ..... 101/477
2001/0025581 A1 * 10/2001 Jehring et al. ..... 101/415.1
2002/0020319 A1 * 2/2002 Grunder ..... 101/477
2002/0066384 A1 * 6/2002 Desheft et al. ..... 101/477
2002/0157553 A1 * 10/2002 Ramsay ..... 101/477

FOREIGN PATENT DOCUMENTS

JP 07-075885 B 8/1995

* cited by examiner

*Primary Examiner*—Eugene H. Eickholt
(74) *Attorney, Agent, or Firm*—Blakely, Sokoloff, Taylor & Zafman

(57) ABSTRACT

A plate inserting apparatus includes a locking portion and suction pad, and a solenoid valve. The locking portion and suction pad hold a plate to which an elastic restoration force is applied. The solenoid valve releases the plate held by the locking portion and suction pad. The plate released by the solenoid valve is inserted into a plate clamp device provided in a plate cylinder by its elastic restoration force.

11 Claims, 8 Drawing Sheets

PLATE INSERTING APPARATUS

BACKGROUND OF THE INVENTION

The present invention relates to a plate inserting apparatus for inserting a new plate in the plate clamp device of a plate cylinder.

Japanese Patent Publication No. 7-75885 (reference 1) discloses a plate inserting apparatus of this type. The apparatus disclosed in reference 1 has a plate magazine supported to be movable between an inserting position for inserting a new plate into the plate clamp device of a plate cylinder and a wait position, a conveyor belt provided in the plate magazine to feed out the new plate into a plate fixing unit, and a driver for driving the conveyor belt. When the plate magazine is located at the inserting position, the conveyor belt is driven by the driver. As a driving belt travels, the new plate is fed out from the plate magazine into the plate clamp device of the plate cylinder, and is mounted on the plate cylinder.

In the conventional plate inserting apparatus described above, since the new plate is fed out into a plate fixing device by the travel of the conveyor belt, the driver for driving the conveyor belt to travel is required. As the driver is large and heavy, a rotational driving unit for rotating the plate magazine also becomes large, and the entire apparatus becomes large and complicated.

SUMMARY OF THE INVENTION

It is an object of the present invention to provide a compact plate inserting apparatus.

It is another object of the present invention to provide a simplified plate inserting apparatus.

In order to achieve the above objects, according to the present invention, there is provided a plate inserting apparatus comprising plate holding means for holding a plate to which an elastic restoration force is applied, and releasing means for releasing the plate held by the plate holding means, wherein the plate released by the releasing means is inserted into a plate fixing unit provided in a plate cylinder by the elastic restoration force thereof.

DESCRIPTION OF THE PREFERRED EMBODIMENT

Figure 1:
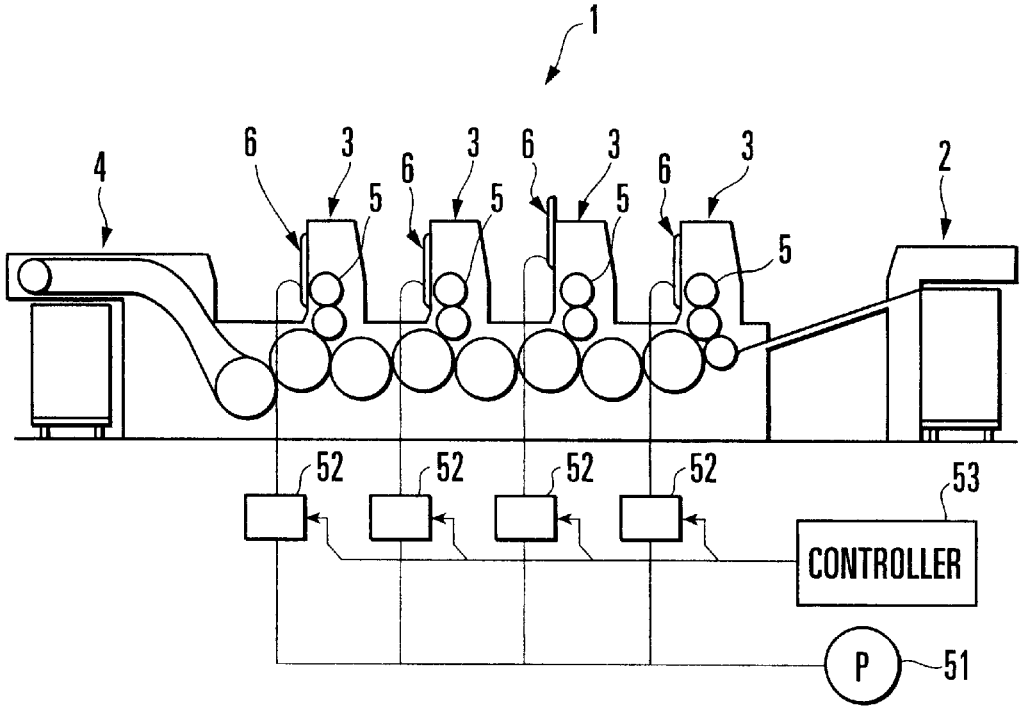
FIG. 1 is a view showing the arrangement of a sheet-fed rotary printing press to which a plate inserting apparatus according to the present invention is applied.

A plate inserting apparatus according to an embodiment of the present invention will be described with reference to FIGS. 1 to 9. As shown in FIG. 1, a sheet-fed rotary printing press 1 has a feeder 2 for feeding sheets, a plurality of printing units 3 corresponding to four different ink colors to print the sheets fed from the feeder 2 in the respective ink colors, and a delivery unit 4 where the sheets delivered from the last printing unit 3 are stacked. A plate cylinder 5 on which a plate is mounted and which is rotatably supported by frames is provided in each printing unit 3, and a safety cover 6 is provided on the delivery side of each printing unit 3. The safety cover 6 is moved up and down (in the vertical direction) by an air cylinder (not shown). When the safety cover 6 moves upward, it opens the front portion of the corresponding plate cylinder 5. When the safety cover 6 moves downward, it covers the front portion of the corresponding plate cylinder 5.

A suction pump 51 is connected to the lower ends of the safety covers 6 to supply suction air to a plurality of suction pads for chucking the front ends of the corresponding plates. Solenoid valves (releasing means) 52 are connected between the suction pump 51 and the suction pads, and open/disconnect air flow channels by their opening/closing operations. The opening/closing operations of the solenoid valves 52 are controlled by a controller 53.

Figure 2A:
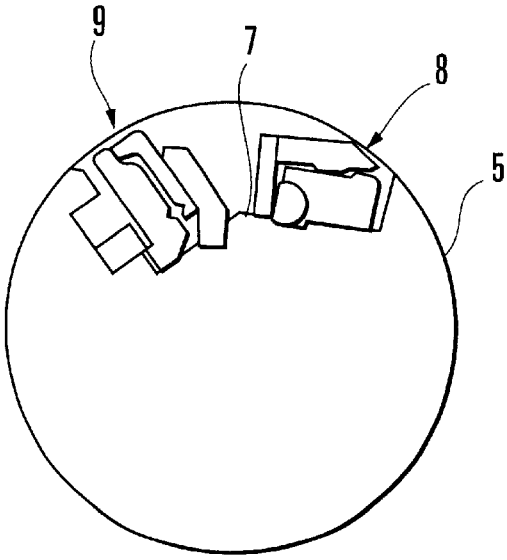
FIG. 2A is a side view showing the structure of the plate cylinder shown in FIG. 1.
Figure 2B:
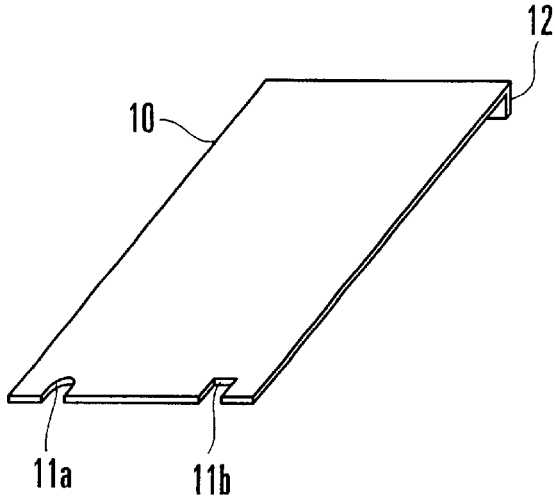
FIG. 2B is a perspective view of a plate to be mounted on the outer surface of the plate cylinder of FIG. 2A.
Figure 3:
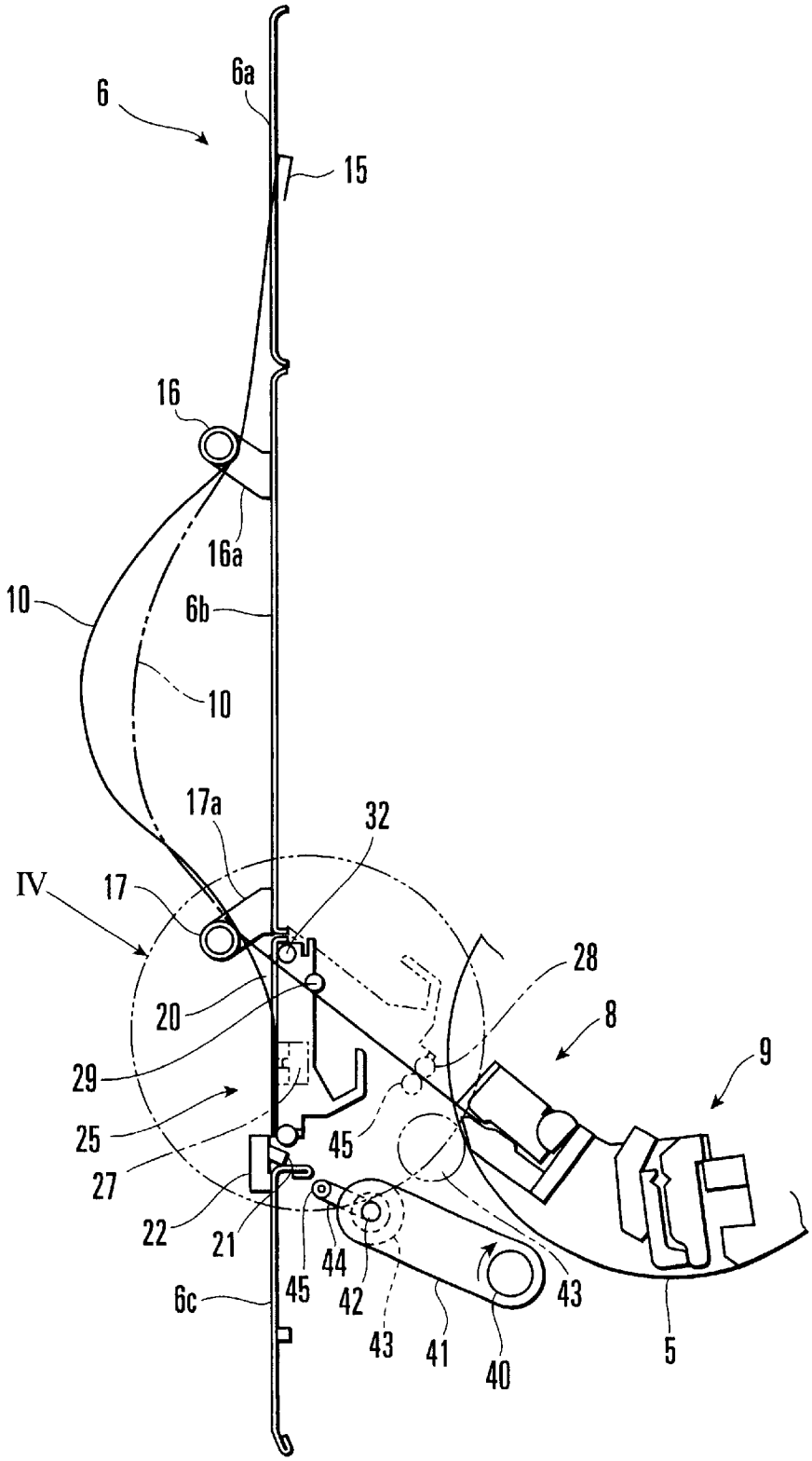
FIG. 3 is a side view of a plate inserting apparatus according to an embodiment of the present invention.

As shown in FIG. 2A, the plate cylinder 5 has a notch 7 in its outer surface to extend in the axial direction. A leading edge plate clamp device 8 and trailing edge plate clamp device 9 are provided in the notch 7. As shown in FIG. 2B, a new plate 10 has a U-shaped positioning notch 11*a* and a positioning notch 11*b* with a semicircular bottom in its leading edge, and a bent portion 12 bent at a right angle in its trailing edge. As shown in FIG. 3, the safety cover 6 is comprised of three covers, i.e., upper, middle, and lower covers 6*a*, 6*b*, and 6*c*. The three covers 6*a*, 6*b*, and 6*c* are sequentially connected to each other, and are integrally moved by the air cylinder (not shown) vertically.

The plate inserting apparatus will be described with reference to FIG. 3 and FIGS. 4A and 4B. As shown in FIG. 3, the upper cover 6*a* has a locking portion 15 with an inverted-L shape, when seen from the side surface, to lock the trailing edge of the new plate 10. A pair of rod-like guide bars 16 and 17 extend parallel to each other at a predetermined distance from the outer surface of the middle cover 6*b*, such that their axes extend in the widthwise direction of the middle cover 6*b*. The two ends of the guide bar 16 and those of the guide bar 17 are supported at the upper and lower portions of the middle cover 6*b* by support members 16*a* and 17*b*, respectively.

A rectangular window 20 extending in the horizontal direction (the widthwise direction of the cover) is formed in the upper portion of the lower cover 6*c*. At positions corresponding to the lower end of the window 20, a pair of positioning pins 21 are fixed to the lower cover 6*c* through a support plate 22. Before mounting the new plate 10 onto the plate cylinder 5, its positioning notches 11*a* and 11*b* are engaged with the positioning pins 21, so that the lower end of the new plate 10 is supported by the positioning pins 21.

Subsequently, after the upper and lower portions of the new plate 10 are supported by the pair of guide bars 16 and 17, the upper end of the new plate 10 is engaged in the locking portion 15 and locked by it. Thus, the new plate 10 elastically deforms in the widthwise direction between the pair of guide bars 16 and 17, and flexes largely. Then, the lower end of the new plate 10 is chucked by suction pads 27 of a plate feed unit 25, and the plate feed unit 25 is swung to come close to the plate cylinder 5. At this time, the new plate 10 keeps flexing between the pair of guide bars 16 and 17, as indicated by an alternate long and two short dashed line in FIG. 3.

When the suction pads 27 release the new plate 10, the lower end (leading edge) of the new plate 10 is inserted in the leading edge plate clamp device 8 of the plate cylinder 5 by the elastic restoration force generated by the flex of the new plate 10. At this time, the pair of guide bars 16 and 17 guide the leading edge of the new plate 10 to insert it into the leading edge plate clamp device 8 of the plate cylinder 5.

Figure 4B:
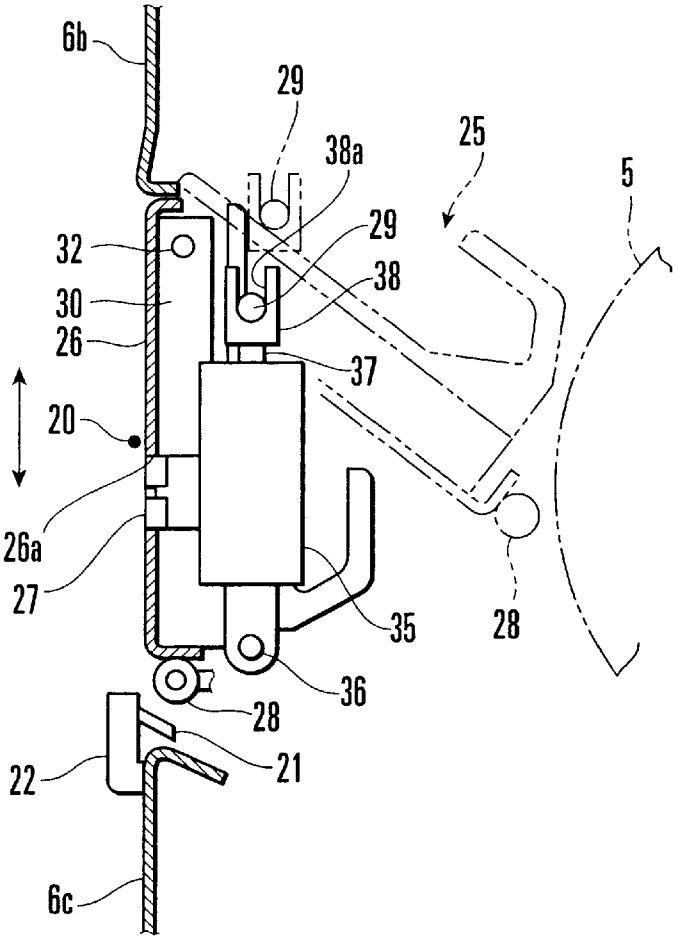
FIGS. 4A and 4B are enlarged views of a portion IV of FIG. 3.
Figure 4A:
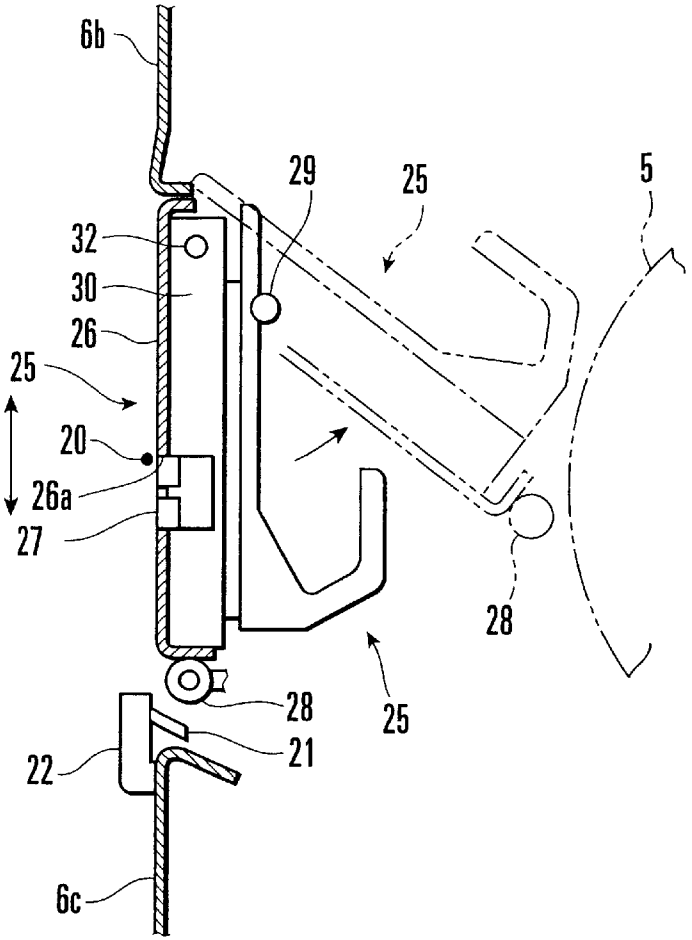
Figure 5:
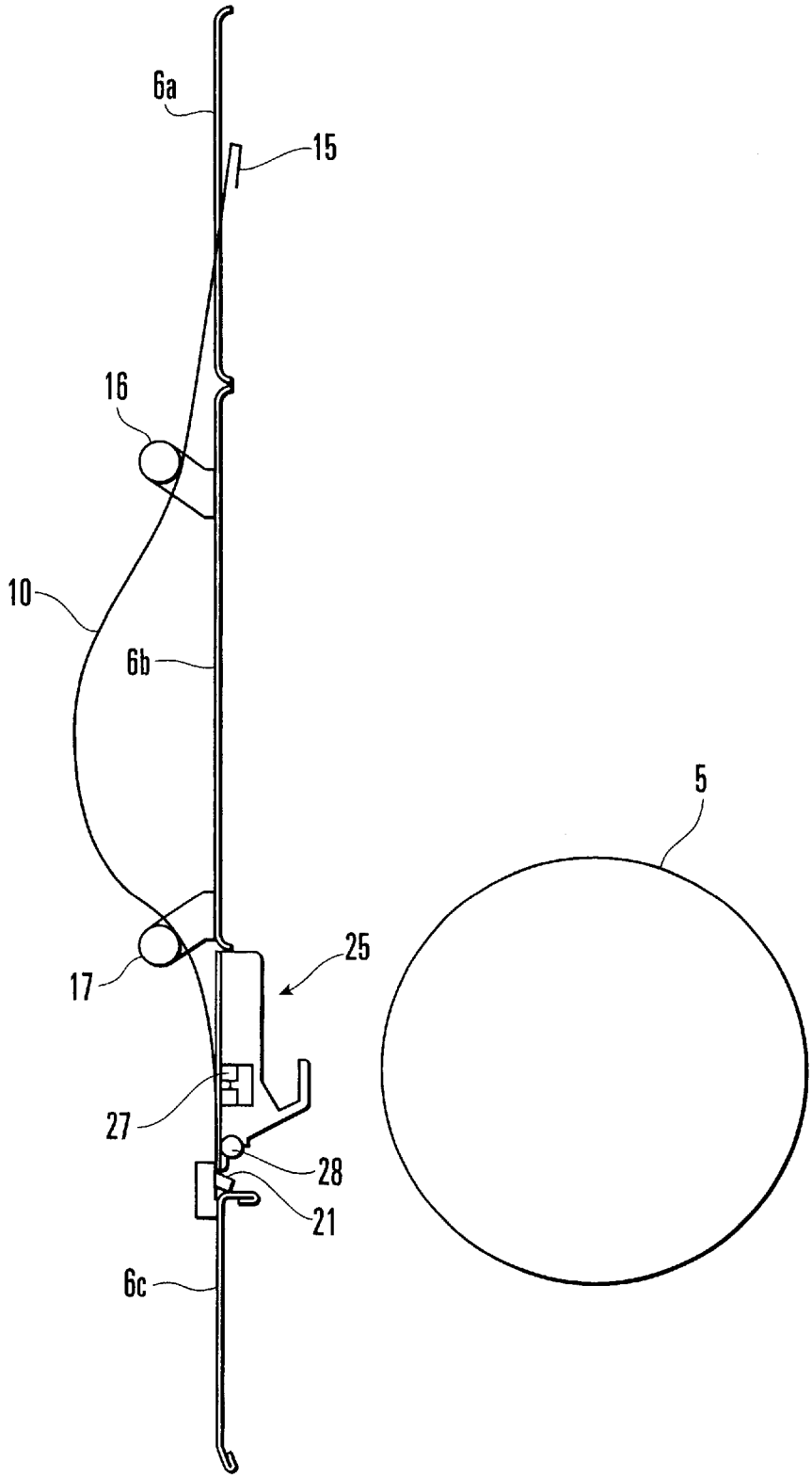
FIG. 5 is a side view of the plate inserting apparatus which has prepared for supplying a new plate.
Figure 6:
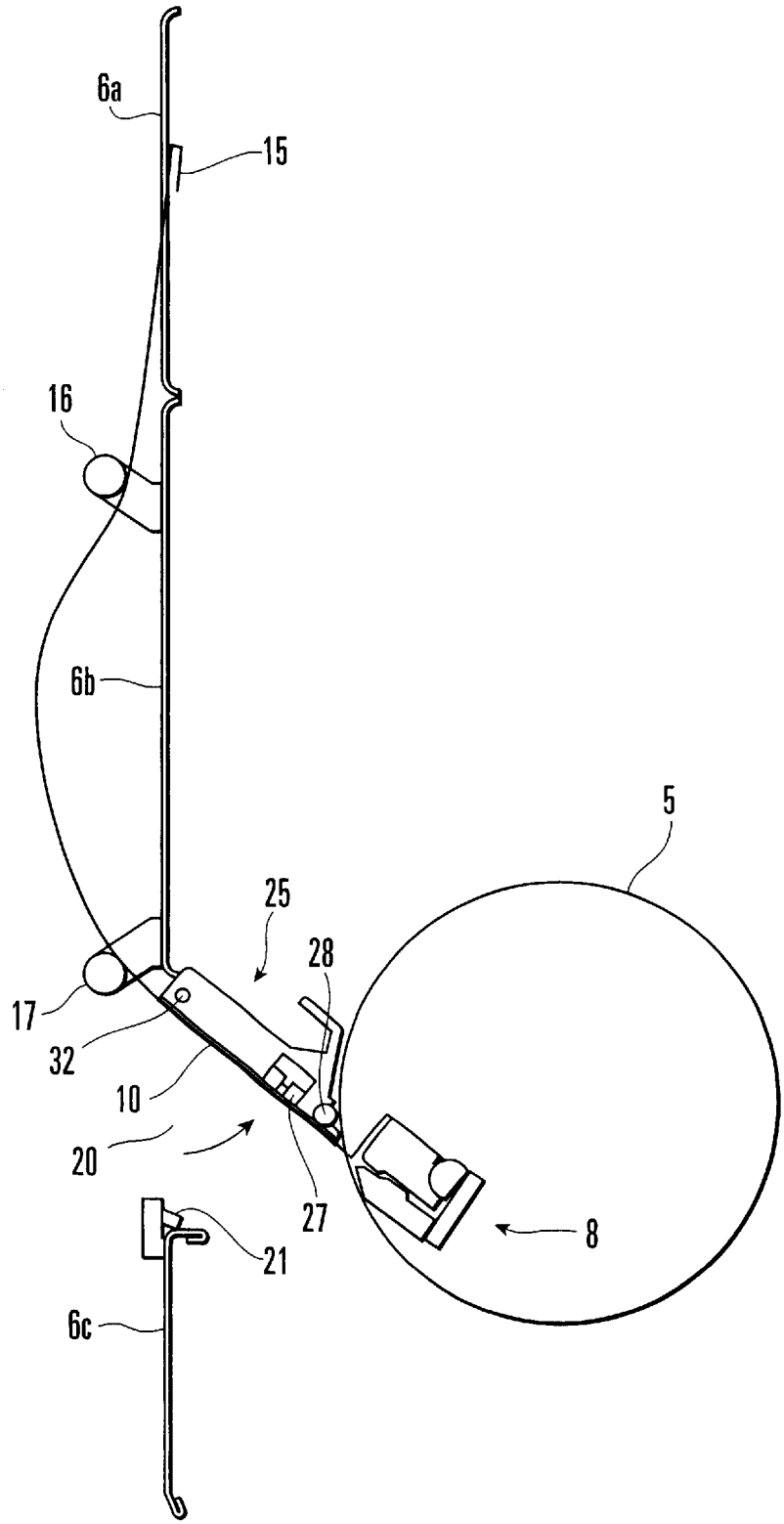
FIG. 6 is a side view of the plate inserting apparatus in a state wherein a plate feed unit is close to the plate cylinder.
Figure 7:
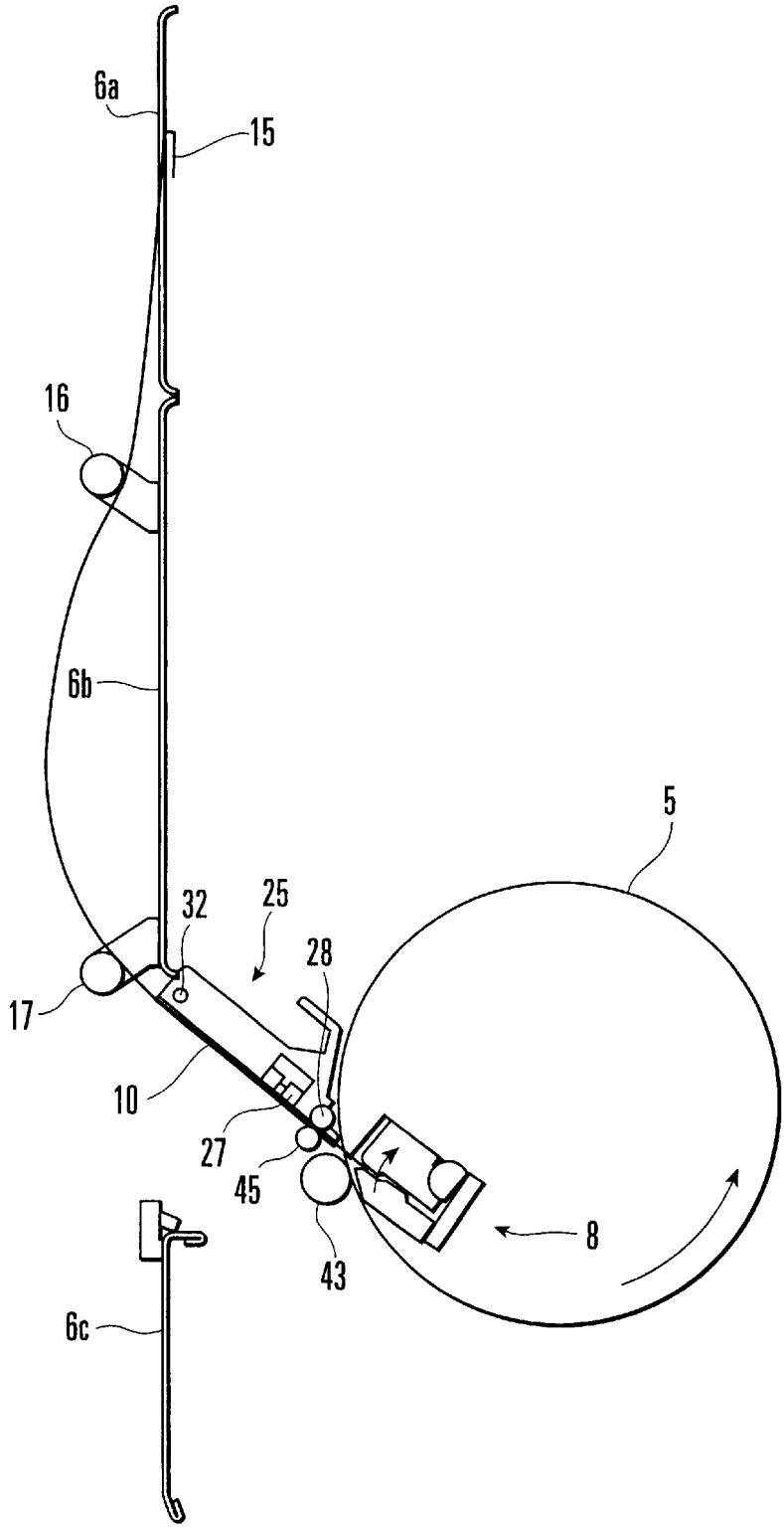
FIG. 7 is a side view of the plate inserting apparatus in a state wherein a plate changing device releases a plate and a new plate is inserted into the leading edge plate clamp device of the plate cylinder.

As shown in FIG. 4A, the plate feed unit 25 as a swing member is comprised of a swing plate 26 for selectively covering the window 20, the suction pads 27 for attracting the new plate 10, a first guide roller (first rotary member) 28 serving as a guide member when inserting the new plate 10 in the plate cylinder 5, and a pin 29 for swinging the swing plate 26. The swing plate 26 has an elongated rectangular shape with a size slightly smaller than that of the window 20, and a pair of opposing bars 30 (one bar 30 is not shown) are fixed to its two ends in the horizontal direction. The swing plate 26 has a plurality of holes 26*a* in its lower portion, through which the suction pads 27 are exposed.

As the upper portions of the bars 30 are rotatably supported by a pivot shaft 32 standing from the lower cover 6*c*, the swing plate 26 is supported by the middle cover 6*b* to be swingable about the pivot shaft 32 as the pivot center. The suction pads 27 are fixed to the rear side of the swing plate 26 through a bracket (not shown), and suction air is supplied to it from the suction pump 51 through the corresponding solenoid valve 52. The pin 29 is fixed to the bars 30 through support plates (not shown), and projects from the sides of the plate feed unit 25.

As shown in FIG. 4B, an air cylinder 35 for swinging the plate feed unit 25 is rotatably supported by an apparatus fixing portion through a small shaft 36 provided to its lower end. An engaging member 38 is attached to the distal end of a rod 37 of the air cylinder 35, and has a U-groove 38*a*, in its upper end, to engage with the pin 29.

In this arrangement, when the rod 37 of the air cylinder 35 moves backward, the plate feed unit 25, in which the pin 29 engages with the U-groove 38*a* of the engaging member 38, covers the window 20, that is, the plate feed unit 25 is located at a wait position away from the plate cylinder 5. When the rod 37 of the air cylinder 35 moves forward as indicated by an alternate long and two short dashed line in FIG. 4B, the plate feed unit 25 pivots counterclockwise about the pivot shaft 32 as the pivot center through the pin 29 engaging with the U-groove 38*a* of the engaging member 38. Hence, the lower end of the plate feed unit 25 is positioned at the inserting position close to the plate cylinder 5.

A second guide roller (second rotary member) 45 for guiding the leading edge of the new plate 10 to the plate cylinder 5, and press rollers 43 for inserting the trailing edge of the new plate 10 into the plate cylinder 5 will be described with reference to FIG. 3. A driving shaft 40 rotatably supported between the pair of frames (not shown) is pivoted by a lever and actuator (not shown). One end of each of a pair of opposing support arms 41 (one support arm 41 is not shown) is fixed to the corresponding one of the two ends of the driving shaft 40, and a shaft 42 extends horizontally between the other-end portions of the support arms 41. The plurality of press rollers 43 are formed on the shaft 42 to line up in the axial direction. One end of a support plate 44 is fixed to the shaft 42, and the other end of the support plate 44 rotatably, axially supports the second guide roller 45.

In this arrangement, when the driving shaft 40 pivots clockwise in FIG. 3, the press rollers 43 come into contact opposite to the outer surface of the plate cylinder 5. Simultaneously, the second guide roller 45 moves in a direction to come close to the first guide roller 28, and clamps the distal end of the new plate 10 chucked by the suction pads 27 together with the first guide roller 28. When the air flow channel is disconnected by the solenoid valves 52, the new plate 10 chucked by the suction pads 27 is released. The released new plate 10 is clamped between the first and second first guide rollers 28 and 45 and guided to the leading edge plate clamp device 8 of the plate cylinder 5. Therefore, the leading edge of the new plate 10 is inserted into the leading edge plate clamp device 8 of the plate cylinder 5, and is gripped by it.

The plate inserting operation of the plate inserting apparatus with the above arrangement will be described with reference to FIG. 4B and FIGS. 5 to 9.

In the initial state, the upper, middle, and lower covers 6*a*, 6*b*, and 6*c* are located in the lower portion. Accordingly, the front portion of the plate cylinder 5 is covered by the middle and lower covers 6*b* and 6*c*. In this state, the notches 11*a* and 11*b* formed in the leading edge (lower portion in FIG. 5) of the new plate 10 engage with the positioning pins 21, so that the lower end of the new plate 10 is supported by the positioning pins 21. The new plate 10 is positioned temporarily by engagement of the notches 11*a* and 11*b* with the positioning pins 21, so that the mounting precision of the new plate 10 with respect to the plate cylinder 5 improves.

Subsequently, the upper and lower portions of the new plate 10 are attached against the pair of guide bars 16 and 17, and the upper end of the new plate 10 is locked by the locking portion 15. Thus, the new plate 10 is supported by the safety cover 6. At this time, the new plate 10 supported by the safety cover 6 largely flexes between the pair of guide bars 16 and 17. Then, the solenoid valve 52 is opened by the control operation of the controller 53, and the lower end of the new plate 10 is chucked by the suction pads 27 of the plate feed unit 25.

Subsequently, the rod 37 of the air cylinder 35 is moved forward, and accordingly the pin 29 engaging with the U-groove 38*a* of the engaging member 38 also moves to the position indicated by an alternate long and two short dashed line in FIG. 4B. As the pin 29 moves, the plate feed unit 25 pivots counterclockwise in FIG. 4B about the pivot shaft 32 as the pivot center. When the plate feed unit 25 pivots, the lower end of the plate feed unit 25 comes close to the plate cylinder 5, and the plate feed unit 25 is accordingly positioned at the inserting position.

At this time, the notches 11*a* and 11*b* disengage from the positioning pins 21, and the front end of the new plate 10 is held only by the suction pads 27. With this arrangement, when the new plate 10 is to be moved to the inserting position, no actuator is needed for moving the positioning pins 21 (backward).

Then, the driving shaft 40 (FIG. 3) pivots clockwise in FIG. 3, and the press rollers 43 come into contact opposite to the outer surface of the plate cylinder 5, as shown in FIG.

7. Simultaneously, the second guide roller 45 comes into contact opposite to the first guide roller 28 through the new plate 10. The solenoid valve 52 is then closed by the control operation of the controller 53, and an air flow channel to the suction pads 27 is disconnected. Hence, the new plate 10 chucked by the suction pads 27 is released, and the lower end (leading edge) of the new plate 10 is inserted into the leading edge plate clamp device 8 of the plate cylinder 5 by the elastic restoration force generated by the flex of the new plate 10.

According to this embodiment, as the new plate 10 is inserted into the leading edge plate clamp device 8 of the plate cylinder 5 by its elastic restoration force, no member is required for moving the new plate 10, and the apparatus is made compact and simplified. As the new plate 10 can flex by its own weight, no driving source is required for inserting the leading edge of the new plate 10 into the leading edge plate clamp device 8 of the plate cylinder 5, and the number of components can be reduced largely. As the new plate 10 can be held and released by supplying and disconnecting the suction air, the structure is simplified.

As the new plate 10 is guided to the leading edge plate clamp device 8 of the plate cylinder 5 by the first and second guide rollers 28 and 45, the leading edge of the new plate 10 can be inserted into the leading edge plate clamp device 8 reliably. When the plate feed unit 25 is located at the position of inserting the new plate 10, the pair of guide bars 16 and 17 guide the new plate 10 to the plate cylinder 5. Thus, the new plate 10 can be inserted into the leading edge plate clamp device 8 of the plate cylinder 5 reliably. The guide bars 16 and 17 support the new plate 10 when the plate feed unit 25 is at a position retreated from the plate cylinder 5. Hence, no exclusive support member is required, and the number of components and the manufacturing cost can be reduced.

Figure 8:
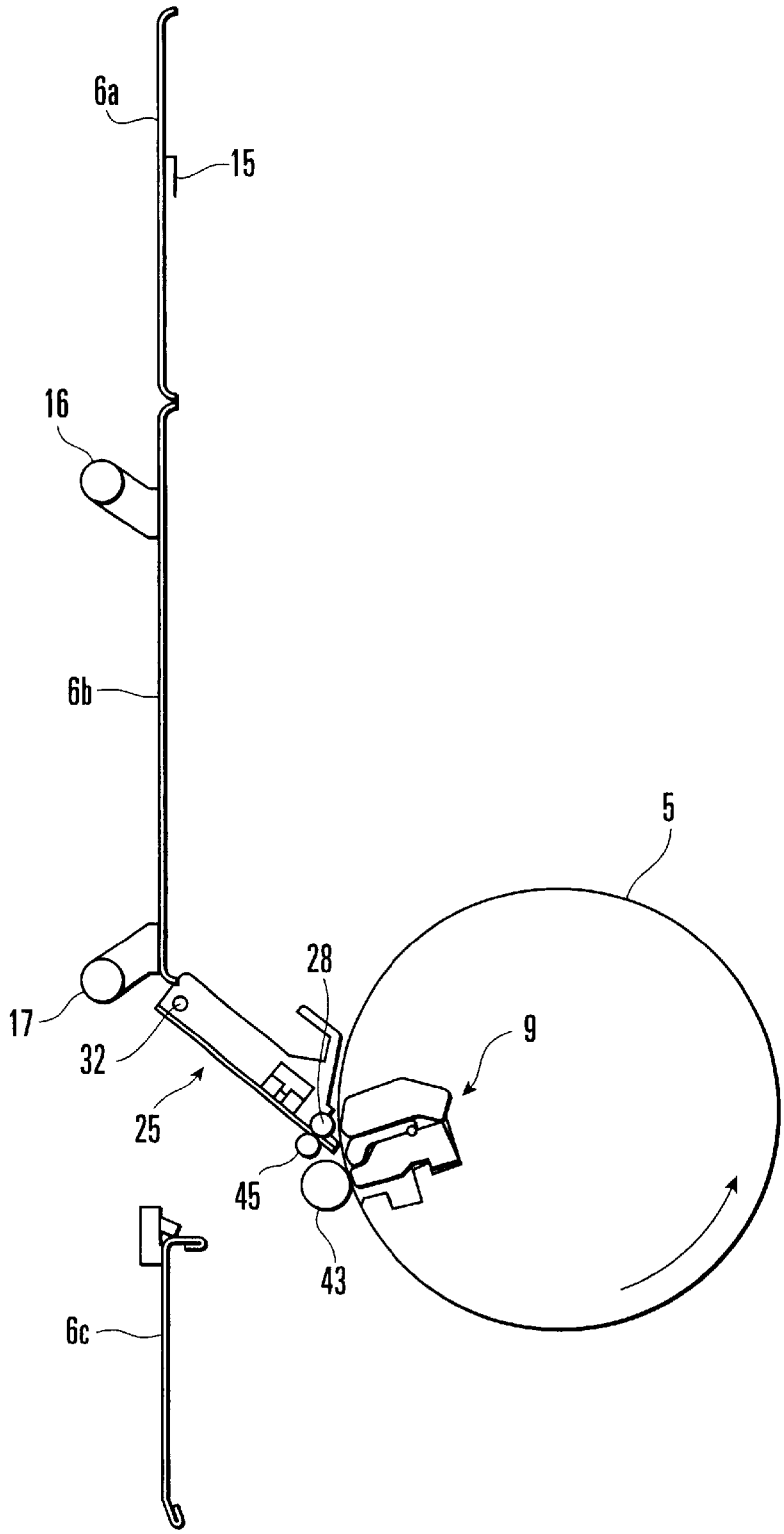
FIG. 8 is a side view of the plate inserting apparatus in a state wherein the new plate is mounted on the plate cylinder.

Subsequently, as shown in FIG. 8, when the plate cylinder 5 pivots counterclockwise, the new plate 10 is pressed by the press rollers 43 to come into tight contact with the outer surface of the plate cylinder 5. When the plate cylinder 5 rotates substantially by one turn, the bent portion 12 of the new plate 10 as the trailing edge is inserted into the trailing edge plate clamp device 9 of the plate cylinder 5 by the press rollers 43. Hence, the trailing edge of the new plate 10 is gripped by the trailing edge plate clamp device 9 of the plate cylinder 5, and the new plate 10 is mounted on the outer surface of the plate cylinder 5.

Figure 9:
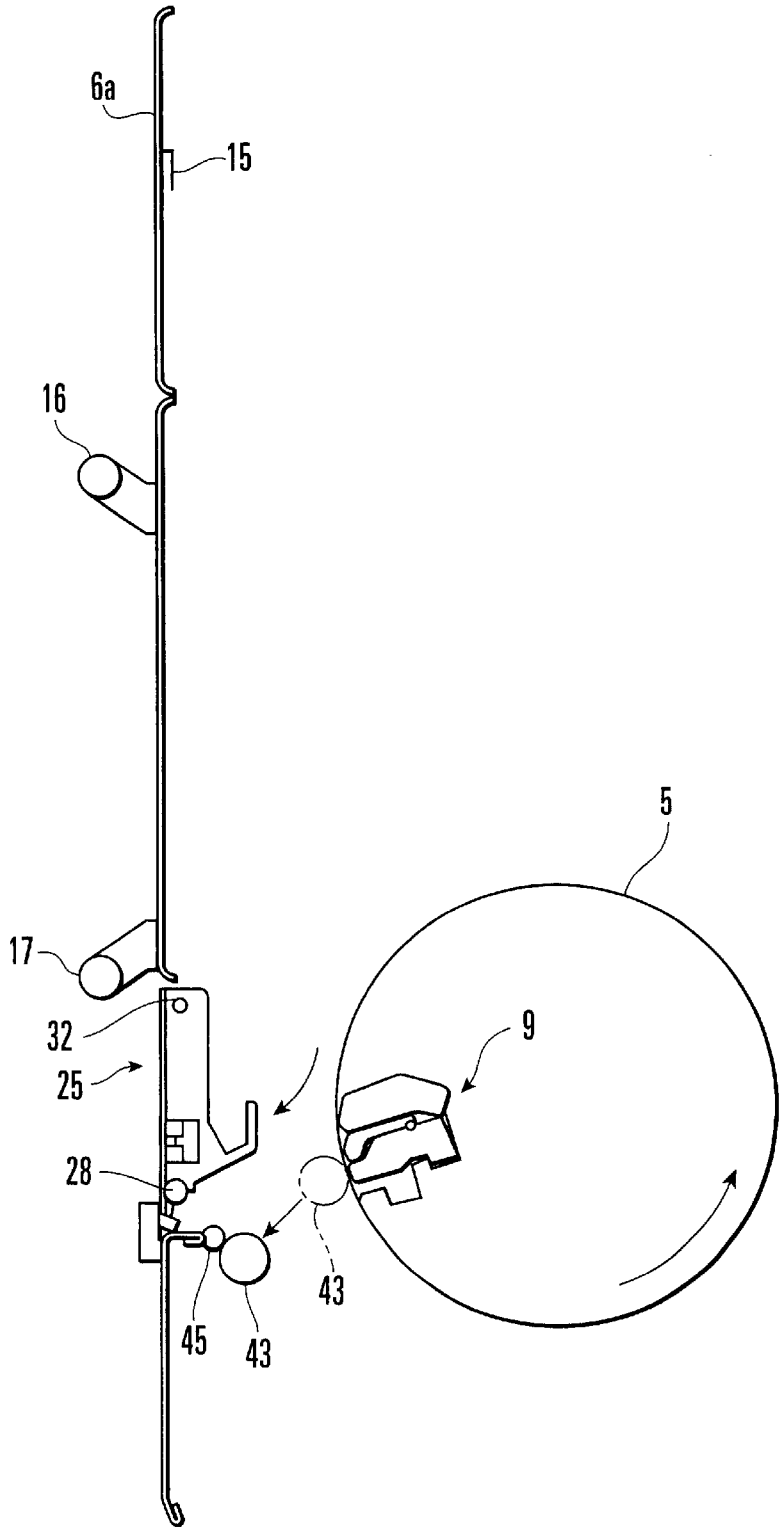
FIG. 9 is a side view of the plate inserting apparatus in a state wherein the plate feed unit is restored to the original position.

Subsequently, as shown in FIG. 4B, the rod 37 of the air cylinder 35 is moved backward as indicated by a solid line, so that the pin 29 engaging in the U-groove 38*a* of the engaging member 38 also moves to the position indicated by a solid line. Thus, as shown in FIG. 9, the plate feed unit 25 pivots by its own weight clockwise in FIG. 9 about the pivot shaft 32 as the pivot center, and is positioned at a position retreated from the plate cylinder 5 to cover the window 20.

As has been described above, according to the present invention, when inserting the plate into the leading edge plate clamp, a convey member for moving the plate and a driving means for driving the convey member become unnecessary. Thus, the apparatus is made compact and simplified.

What is claimed is:

1. A plate inserting apparatus comprising:

plate holding means for holding a plate to which an elastic restoration force is applied; and releasing means for releasing the plate held by said plate holding means, wherein the plate released by said releasing means is inserted into a plate fixing unit provided in a plate cylinder by the elastic restoration force thereof.

2. An apparatus according to claim 1, wherein said plate holding means holds a front end and rear end of the plate as the plate is in a flexed state.

3. An apparatus according to claim 1, wherein said plate holding means comprises a plate holder for holding the front end of the plate with suction air supplied from a suction air source, and a locking portion for locking the rear end of the plate.

4. An apparatus according to claim 3, wherein said releasing means releases the held front end of the plate by disconnecting supply of the suction air to said plate holder.

5. An apparatus according to claim 4, wherein said plate holder is supported to be movable between a wait position and an inserting position for inserting the plate into said plate fixing unit, and said releasing means releases the held plate when said plate holder moves to the inserting position while supporting the front end of the plate.

6. An apparatus according to claim 5, wherein said apparatus further comprises a first rotary member which is rotatably supported by said plate holder and comes close to said plate fixing unit when said plate holder moves to the inserting position, a second rotary member supported to be rotatable and movable, and moving means for moving said second rotary member in a direction to come close to said first rotary member when said plate holder moves to the inserting position, and said first and second rotary members clamp the plate when inserting the plate into said plate fixing unit.

7. An apparatus according to claim 6, further comprising a cover having a window to cover a front surface of a plate cylinder, a swing plate to which said plate holder is fixed and which is swingably supported at an upper end of said window, said plate holder being located at the wait position when said swing plate covers said window, and at the inserting position when said swing plate comes close to the plate by a swing motion, and a press roller for pressing the plate against an outer surface of said plate cylinder when inserting the plate.

8. An apparatus according to claim 5, wherein said apparatus further comprises a swing lever for rotatably supporting said press roller at a distal end thereof, said first rotary member is rotatably supported at the distal end of said swing lever, said second rotary member is rotatably supported by said swing lever through a support member, and along with a swing motion of said swing lever, when said second rotary member moves in a direction to come close to said first rotary member, the front end of the plate held by said plate holder is clamped between said first and second rotary members.

9. An apparatus according to claim 5, further comprising a positioning pin which engages with the front end of the plate, when said plate holder is at the wait position, to position the plate.

10. An apparatus according to claim 9, wherein said apparatus further comprises a cover having said positioning pin to cover a front surface of a plate cylinder, and said positioning pin disengages from the front end of the plate when said plate holder moves to the inserting position.

11. An apparatus according to claim 2, further comprising a guide member which, in a wait mode, supports a portion between the front and rear ends of the plate held in a flexed state and, in a plate insertion mode, guides the plate which moves by the elastic restoration force thereof toward said plate fixing unit.

* * * * *